US011125435B2

(12) United States Patent
Godel et al.

(10) Patent No.: US 11,125,435 B2
(45) Date of Patent: Sep. 21, 2021

(54) BENT COMBUSTION CHAMBER FROM A TURBINE ENGINE

(71) Applicant: Safran Aircraft Engines, Paris (FR)

(72) Inventors: Guillaume Aurelien Godel, Moissy-Cramayel (FR); Alain Rene Cayre, Moissy-Cramayel (FR); Romain Nicolas Lunel, Moissy-Cramayel (FR); Haris Musaefendic, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 171 days.

(21) Appl. No.: 15/742,447

(22) PCT Filed: Jul. 7, 2016

(86) PCT No.: PCT/FR2016/051735
§ 371 (c)(1),
(2) Date: Jan. 5, 2018

(87) PCT Pub. No.: WO2017/006063
PCT Pub. Date: Jan. 12, 2017

(65) Prior Publication Data

US 2018/0209649 A1 Jul. 26, 2018

(30) Foreign Application Priority Data

Jul. 8, 2015 (FR) ..... 1556482

(51) Int. Cl.
*F23R 3/14* (2006.01)
*F23R 3/42* (2006.01)

(52) U.S. Cl.
CPC ..... *F23R 3/14* (2013.01); *F23R 3/425* (2013.01); *F23R 2900/03342* (2013.01)

(58) Field of Classification Search
CPC .... F23R 3/02; F23R 3/04; F23R 3/045; F23R 3/10; F23R 3/14; F23R 3/283; F23R 3/42;
(Continued)

(56) References Cited

U.S. PATENT DOCUMENTS 2,867,267 A * 1/1959 Nerad ..... F23R 3/14 431/190
3,605,405 A * 9/1971 Du Bell ..... F23R 3/14 60/737
(Continued)

FOREIGN PATENT DOCUMENTS

WO WO2016/174363 A1 11/2016

OTHER PUBLICATIONS

Preliminary Research Report received for French Application No. 1556482, dated Apr. 26, 2016, 5 pages (1 page of French Translation Cover Sheet and 4 page of original document).
(Continued)

*Primary Examiner* — Scott J Walthour
(74) *Attorney, Agent, or Firm* — Womble Bond Dickinson (US) LLP

(57) ABSTRACT

A turbine engine combustion chamber including: an outer annular housing; a flame tube connected to the outer housing. The flame tube includes an inner annular wall and an outer annular wall and a second axial outlet portion of the flame tube. The flame tube also includes a chamber base located at the inlet of the flame tube; and a fuel injection system configured to inject fuel into the flame tube via the inlet of the flame tube. The injection system includes an injector axis, and an air manifold to move air towards twists in the injection system. The twists are arranged around an implantation axis. The air manifold includes a circular portion around the injector axis. The circular portion, forms
(Continued)

an air inlet of the manifold. The opening places the entering air flow in rotation about the implantation axis.

8 Claims, 7 Drawing Sheets

(58) Field of Classification Search
CPC .... F23R 3/425; F23R 3/50; F23R 3/52; F23R 3/54; F23R 3/58; F23R 2900/03342
See application file for complete search history.

(56) References Cited

U.S. PATENT DOCUMENTS 3,648,457 A * 3/1972 Bobo ..... F23R 3/14 60/737
3,808,802 A * 5/1974 Tanasawa ..... F23R 3/58 60/755
4,081,957 A 4/1978 Cox, Jr.
2006/0213180 A1* 9/2006 Koshoffer ..... F02K 3/10 60/226.1
2008/0006033 A1* 1/2008 Scarinci ..... F02C 3/14 60/776
2010/0083664 A1* 4/2010 Mancini ..... F23R 3/14 60/752

OTHER PUBLICATIONS

International Search Report and Written Opinion received for PCT Patent Application No. PCT/FR2016/051735, dated Oct. 7, 2016, 18 pages (9 pages of English Translation and 9 pages of Original Document).
International Preliminary Report on Patentability received for PCT Patent Application No. PCT/FR2016/051735, dated Jan. 18, 2018, 16 pages (9 pages of English Translation and 7 pages of Original Document).

* cited by examiner

BENT COMBUSTION CHAMBER FROM A TURBINE ENGINE

GENERAL TECHNICAL FIELD

The invention relates to the field of combustion chambers for turbine engines and more particularly the structure and attachment of a flame tube in a combustion chamber of a turbine engine.

STATE OF THE ART

In known fashion and in relation with FIG. 1, downstream of a high-pressure compressor (not shown), a turbine engine comprises a combustion chamber delimited by the inner 1*b* and outer 1*a* rotationally symmetrical casings which are concentric.

The combustion chamber comprises a flame tube 2 disposed in the space defined by the inner 1*b* and outer 1*a* casings.

The flame tube 2 is delimited by inner 2*b* and outer 2*a* walls called the inner and outer shrouds and a chamber base plate 3 which serves as a support for the injectors 4.

Moreover, the combustion chamber also comprises a fairing 5 disposed in front of the chamber base to partially cover the injectors 4 in order to protect them against possible shocks (which the ingestion of a bird or of a block of ice into motors may produce) and to reduce the aerodynamic energy losses to improve the fuel consumption of the engine. And the combustion chamber comprises an air diffuser 6 leading to the injector 4 which allows the injectors 4 to be cooled.

The base plate 3, the inner 2*b* and outer 2*a* walls of the flame tube 2 and the fairing 5 are assembled by bolts (not shown).

The combustion chamber of FIG. 1 is called direct axial annular in the sense that it extends along the preferred direction of the engine axis without turnover of the cylindrical shrouds of the flame tube. This architecture is the reference point for modern turbine engines, particularly at high power. In the low power field, it cohabitates with the reversing chamber architecture which is axially very compact. However, it has as its principal disadvantage a high surface-to-volume ratio which makes the cooling of the walls of the flame tube difficult and handicaps their lifetime.

On the other hand, a problem with the direct axial chamber type is that the axial space required for the flame tube is considerable.

Another problem is that the attachments of the fairing, the inner 2*b* and outer 2*a* walls and of the base plate are subjected to vibrations of the turbine engine as well as to thermal dilations of the sub-components of the chamber module which may degrade its operation so that generally complex vibratory and thermal compensation systems are provided.

PRESENTATION OF THE INVENTION

The invention proposes to mitigate at least one of these disadvantages.

To this end, the invention proposes, according to a first aspect, a combustion chamber of a turbine engine comprising: an outer annular casing; a flame tube connected to the outer casing, said flame tube comprising an inner annular wall and an outer annular wall defining, on the one hand, a first radial portion at the inlet of the flame tube and on the other hand a second axial portion at the outlet of the flame tube, the flame tube further comprising a chamber base located at the inlet of the flame tube; a fuel injection system configured to inject fuel into the flame tube via the inlet of the flame tube, the injection system comprising an injector axis which is parallel to the first portion, and an air manifold configured to bring air toward twists of the injection system, the twists being disposed around an implantation axis which is parallel to the injector axis, the air manifold comprising a circular part around the injector axis, the circular part from which extends an opening forming an air inlet of the manifold, the opening being configured to set the incoming air flow in rotation around the implantation axis so at it feeds the twists.

The invention is advantageously completed by the following features, taken alone or in any one of their technically possible combinations.

The opening comprises a straight part which extends tangentially at the circular part and a divergent part extending from the circular part.

The circular part has a constant radius around the injector axis.

The circular part has an increasing radius around the injector axis.

The opening has a general shape: circular, rectangular, profiled.

The flame tube is connected to the outer casing through said injection system in connection with the chamber base.

The injector has a main direction coaxial with a longitudinal axis Y along which the first portion extends.

The first portion of the flame tube extends toward the second portion by forming a bend between the inlet and the outlet of the flame tube.

The invention also relates to a turbine engine comprising a combustion chamber according to the invention.

The invention allows to bring air from the diffuser more effectively. In other words, the invention allows to reduce the head loss between the diffuser and the inlet of the manifold.

In fact, in the case of a conventional architecture and according to the current state of the art, the flow at the compressor outlet partially supplies the injector (between 10% and 30% of the total compressor outlet flow rate). The remaining percentage is both reintroduced along the flame tube via the different perforations (primary holes, dilution holes and multi-perforation) and is also used to cool a set of parts of the turbine module. The diffuser (compressor outlet) allows to slow down the flow rate, which is then fragmented before feeding the injection system and the inner/outer bypasses, this for the purpose of reducing head losses during bypass. This singular transition between the compressor outlet and the injection system is not optimum because it is the source of energy losses: the flow is first slowed down at the compressor outlet, follows several passages (crossing the fairing and bypassing the injection system) then is re-accelerated at the inlet of the injection system.

Thus, the invention solves this set of problems by disposing, between the diffuser outlet and the inlet of the injection system, a manifold the role of which is to capture a part of the air flow and achieve aerodynamic continuity. This device allows optimization of the compressor outlet/injection system connection, channeling of the flow in the direction of the injection system and reducing the crossing of openings or the bypassing of parts by the flow.

In addition, the particular form of the manifold allows the air flow to be oriented before its admission into the injection system so as to improve the feeding of the injection system.

In fact, in the case of a conventional architecture and according to the current state of the art, the injection system is composed of several twists the role of which is to generate a rotating flow at the outlet of the injection system. These twists have a pitch angle (between 10° and 80° with respect to the injector axis).

The feeding of the twists is not optimal in the case of a conventional injection system of which the principal axis is inclined with respect to the average flow direction at the outlet of the diffuser. The flow may be caused to carry out considerable changes in direction to supply a twist, which forms singular transition, deleterious to the performance of the combustion chamber module.

Thus, the invention which resolves this set of problems consists of using one of the two lateral walls of the manifold to orient the flow prior to its admission into the injection system without applying any other considerable change in direction to the flow other than that expected due to its being set in rotation. This technical solution allows to generate a general rotation movement around the axis around which are disposed the twists, beneficial to the feeding of the twists.

PRESENTATION OF THE FIGURES

Other features, aims and advantages of the invention will be revealed by the description that follows, which is purely illustrative and not limiting, and which must be read with reference to the appended drawings in which, other than FIG. 1 already discussed, FIG. 2 illustrates a section view of a combustion chamber;

In all the figures, similar elements carry identical reference symbols.

DETAILED DESCRIPTION OF THE INVENTION

Figure 1:
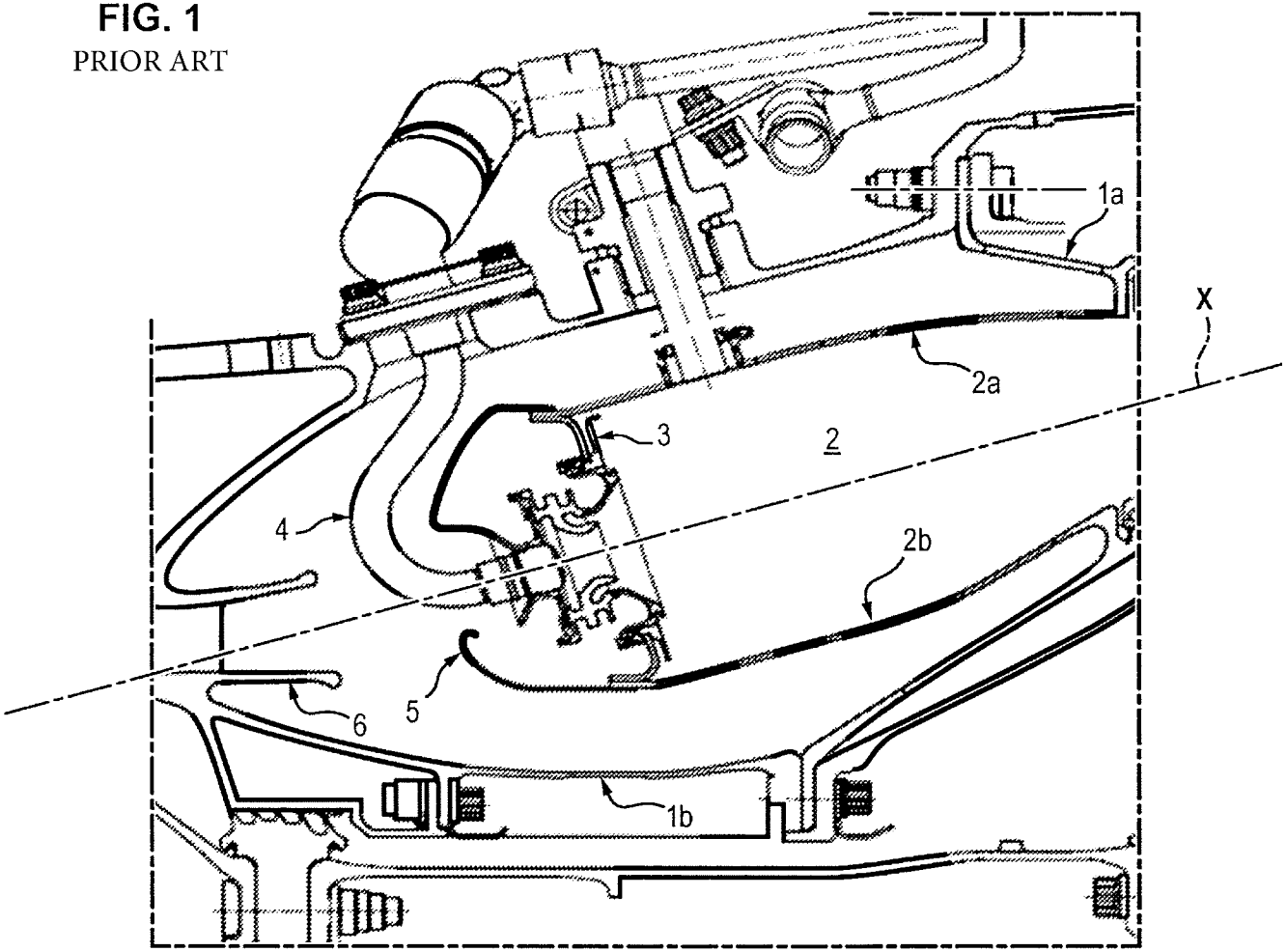
FIG. 1 PRIOR ART
Figure 2:
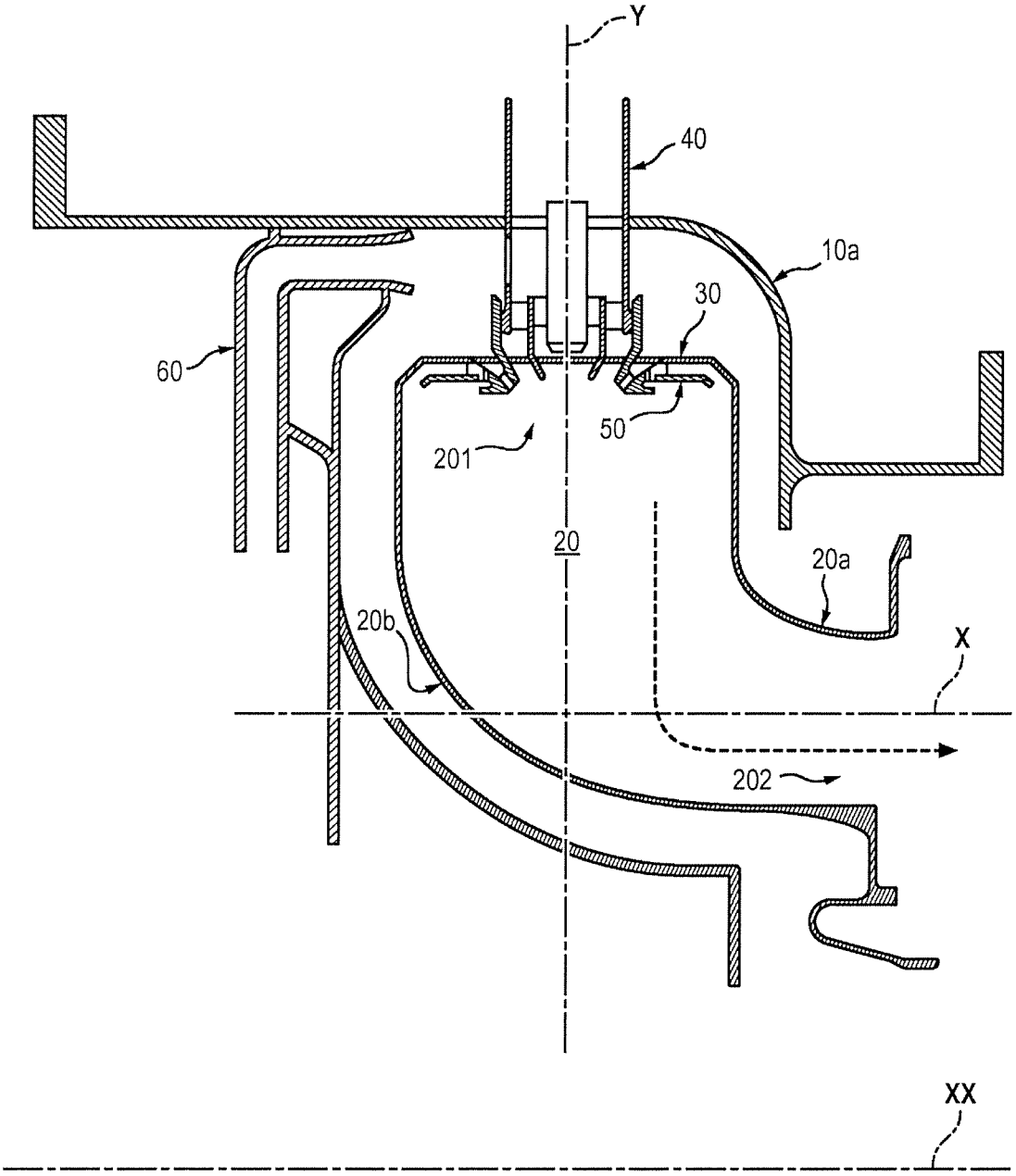
Figure 3:
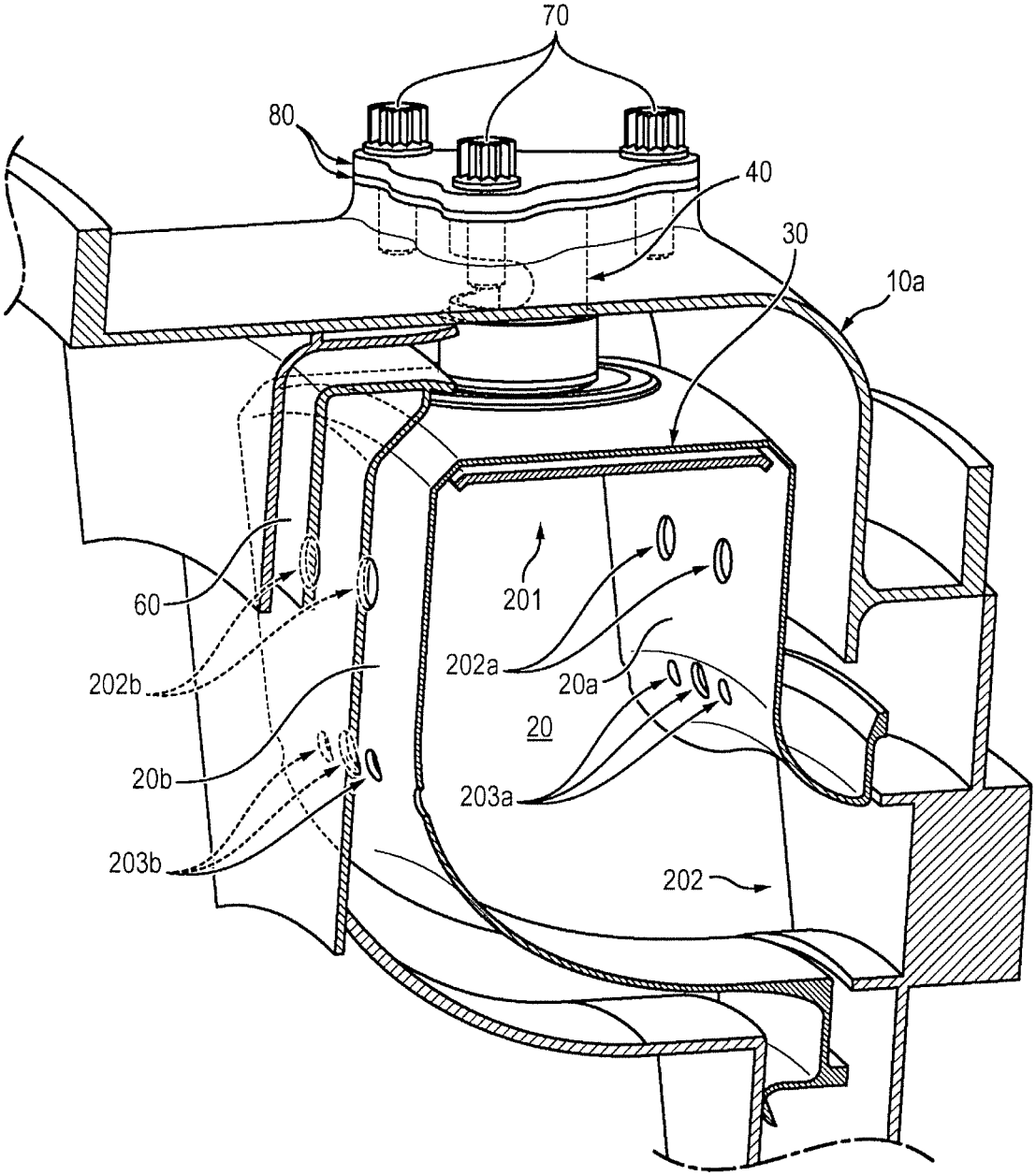
FIG. 3 illustrates a perspective view of a combustion chamber.

FIGS. 2 and 3 illustrate views of a combustion chamber according to one embodiment.

The combustion chamber comprises an outer casing 10*a* to which a flame tube 20 is connected.

The flame tube 20 comprises an annular inner wall 20*b* and an annular outer wall 20*a*.

The annular inner and outer walls define, on the one hand, a first radial portion 201 around a radial axis Y of the combustion chamber and which extends radially with respect to a longitudinal axis XX of rotation of the turbine engine.

On the other hand, the annular inner and outer walls define a second axial portion 202 around a longitudinal axis X perpendicular to the radial axis Y and parallel to the longitudinal axis XX of rotation of the turbine engine.

As may be seen in FIGS. 2 and 3, the first portion 201 extends toward the second portion 202 by forming a bend between the inlet and the outlet of the flame tube.

Such a bend allows an effective aerodynamic connection with a high-pressure stage downstream of the gas flow (dotted arrow in FIG. 2).

In addition, this bent shape allows the axial use of space of the flame tube 20 to be reduced.

This has the following advantages.

- the mass of the engine is reduced:
  - the shape of the flame tube allows a reduction in the length of the outer casing, which is often common with the high-pressure turbine downstream of the combustion chamber;
  - a reduction in length for the equipment—ducts—nacelle and all the "out-of-stream" constituents;
  - the structure of the chamber is simplified in particular by the fact that the flame tube is connected to the outer casing through the injector, which allows the elimination of the enclosures and the associated bolts. These parts are generally used on direct axial type chambers;
- the dynamic situation of the high-pressure rotor, located below the combustion chamber, is improved:
  - this part is in fact a complex element of the turbine engine and must satisfy numerous dimensioning criteria. For turbine engines with small dimensions and with high performance requirements (in fuel consumption and emissions), it is tempting to position a high rotation speed: the difficulty then being to ensure acceptable stiffness and shaft dynamics. Thus, the bent shape given the flame tube allows to reduce the high-pressure shaft length (consisting of a high-pressure compressor upstream of the combustion chamber and the high-pressure turbine downstream of the combustion chamber);
- the interface with the high-pressure turbine is improved:
  - in fact, the outlet of the flame tube is collinear with the design of DHP platforms: this allows to limit the number of lines of flow currents which would impact the wall (particularly on the inner shroud) and could potentially interfere with the cooling of these parts, the lifetime of which is critical
- the ignition plug may be positioned at different positions:
  - at the chamber base and/or at a chamber corner and/or on the outer wall.

The combustion chamber also comprises a chamber base 30 which has the shape of a plate located at the inlet of the flame tube 20.

Attached to this chamber base 30 is an injection system 40 of a first type through which the flame tube 20 is connected to the outer casing 10*a* of the turbine engine.

In addition, the combustion chamber may possibly comprise a thermal shield 50 in the form of a plate attached to the chamber base 30 located in the flame tube 20. This thermal shield 50 is located at the inlet of the flame tube 20 and protects the injection system 40 from high temperatures greater than 2200 K which may occur in the flame tube 20.

Primary holes 202*a*, 202*b* are drilled in the inner and outer annular walls at the first portion 201 at the inlet of the flame tube.

In addition, dilution holes 203*a*, 203*b* are drilled in the inner and outer annular walls at the bent part of the flame tube 20 (see FIG. 3). The number of holes, their diameters and respective positions may vary depending on the application concerned.

Moreover, a diffuser 60 allows to bring air to the injection system 40 so as to cool it.

Figure 4:
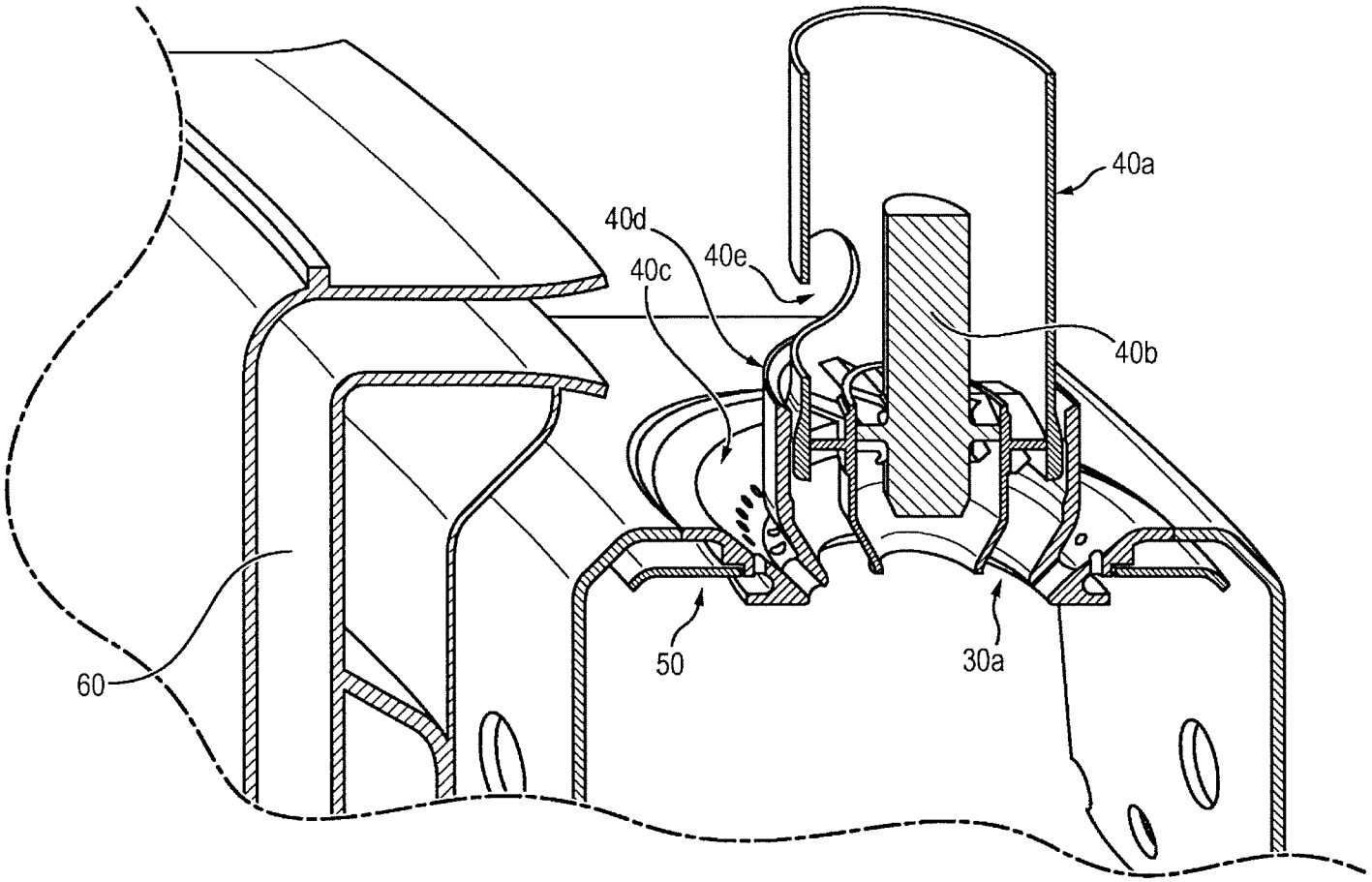
FIG. 4 illustrates a detailed view of the connection of the combustion chamber according to a first embodiment.

As may be seen in FIG. 4, the injection system 40 according to a first embodiment comprises an injector body 40*a* surrounding an injection pipe 40*b* through which the fuel as such is delivered into the flame tube 20. The injector body 40*a* is attached to the outer casing 10*a* by means of bolts 70 and attachment plates 80 (see FIG. 3).

The inner and outer annular walls are attached to the outer casing 10*a* by means of the injector body 40*a*, thus allowing the simplification of the bowl-chamber base connection and thus avoiding the use of a clearance compensation system.

A connection disk 40*c* topped with a cylinder 40*d* in which is inserted the body 40*a* of the injector is connected to the chamber base 30 wherein a recess 30*a* with the size of the connection disk has been provided.

The injector body 40*a* is in connection with the injection pipe 40*b* and the body 40*a* of the injection system 40 is inserted into the cylinder 40*d* on top of the connection disk 40*c* in such a manner that the injector body 40*a* (and therefore the injection pipe 40*b*) is movable with respect to the cylinder 40*d*. This allows compensation of the movements to which the flame tube 20 is subjected. There is therefore no need for complex compensation systems.

The injector body 40*a* comprises an air inlet 40*e* through which the air from the diffuser 60 is introduced. This air allows to supply the injection system 40 with air. The air inlet 40*e* has, with no limitation, the shape of an oval recess formed in the body 40*a* of the injector. It will therefore be understood that other shapes may be contemplated.

Figure 5:
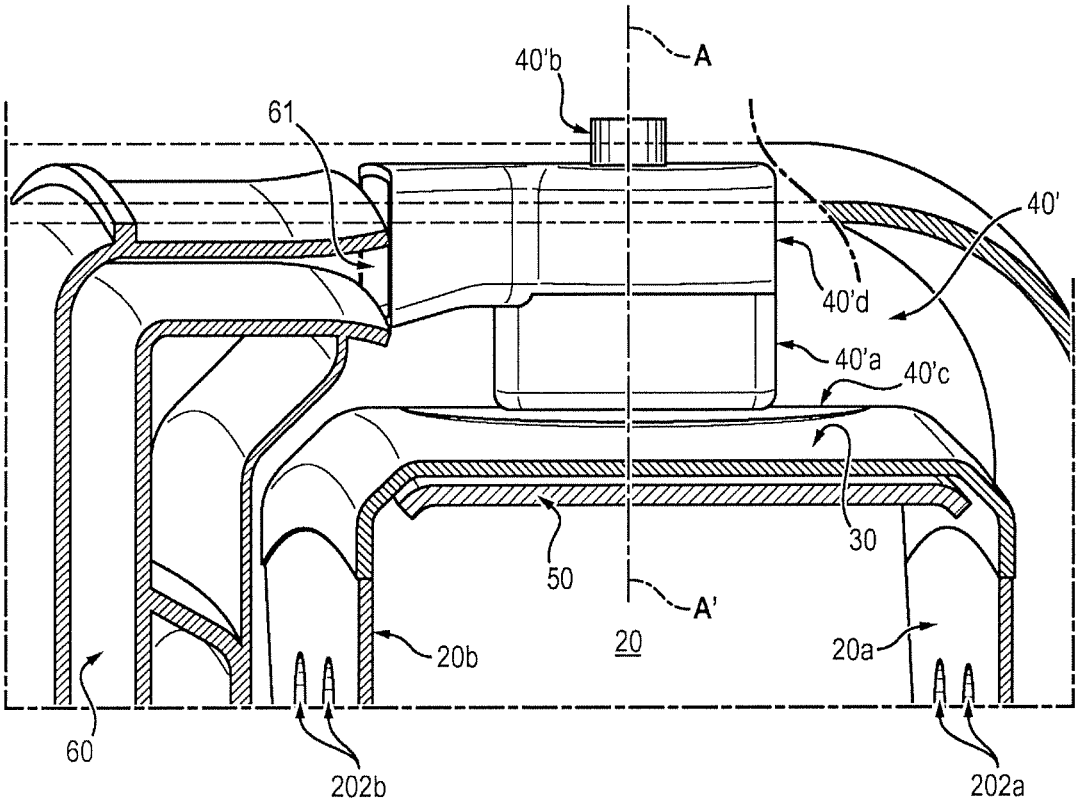
FIG. 5 illustrates a detailed view of the combustion chamber according to a second embodiment.

Alternatively, as may be seen in FIG. 5, the combustion chamber according to a second embodiment differs from the first embodiment by the structure of an injection system 40' of a second type.

The flame tube 20 involved in this second embodiment is identical with that previously described. Moreover, the injection system 40' is attached to the chamber base 30, the flame tube 20 being connected to the outer casing 10*a* of the turbine engine by means of the injection system 40'.

The injection system 40' in this second embodiment comprises an injector body 40'*a* on top of a circular connection structure 40'*c* comprising at least one connection disk. The connection structure 40'*c* is inserted into the chamber base 30 in which a recess with the size of the circular connection structure has been provided. The manifold 40'*d* is secured to the injector body 40'*a*.

As in the first embodiment, the inner and outer annular walls are attached to the outer casing 10*a* by means of the injector body 40'*a*, thus allowing simplification of the bowl-chamber base connection and thus avoiding the use of a clearance compensation system.

The injector body 40'*a* surrounds an injection pipe 40'*b* (along the injector axis AA') through which the fuel as such is brought into the flame tube 20. The injector axis AA' is congruent with the radial axis Y so as to be parallel to the first radial portion 201 of the flame tube 20.

In order to improve the efficiency of the air supply of the injection system by means of twists applied to the pipe 40'*b*, an air manifold 40'*d* tops the injection pipe 40'*b*. The twists are formed by bladings positioned around an implantation axis parallel to the injector axis AA'. The implantation axis around which the twists are located and the injector axis AA' may be congruent.

This manifold is arranged in proximity to the diffuser 60 without being connected to the latter (in which case vibrations could damage the structure). In addition, the manifold is separated physically from the diffuser because of dilation speeds which are different.

Figure 6:
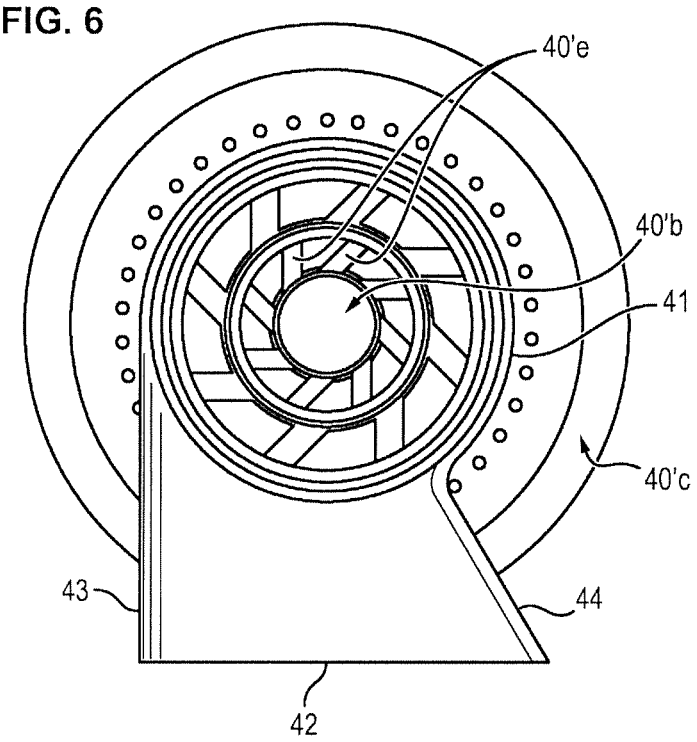
FIGS. 6 and 7 illustrate a manifold of a first type of the combustion chamber according to a second embodiment.
Figure 7:
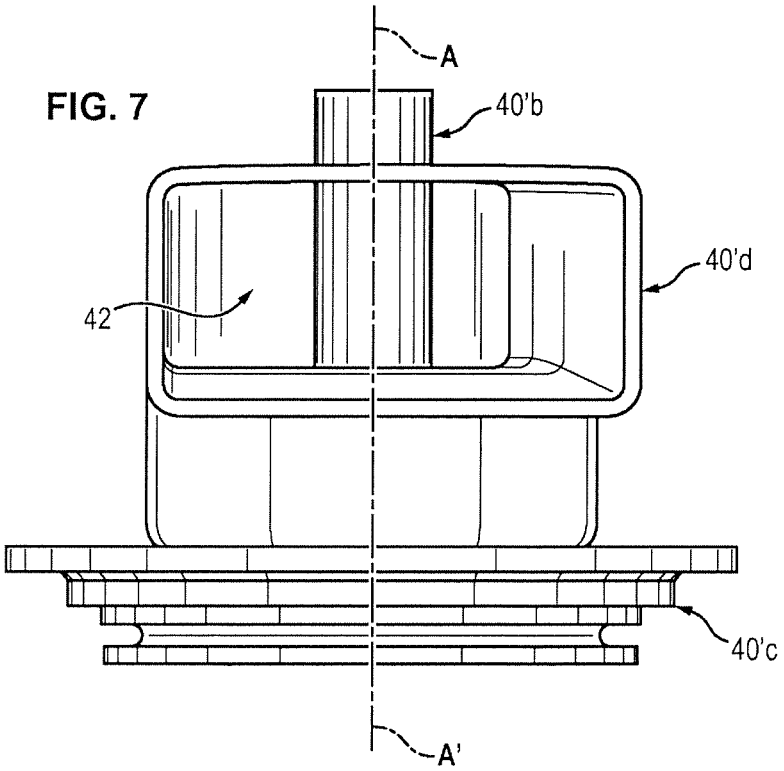

As illustrated in FIGS. 6 and 7, the air manifold 40'*d* may be in the axis AA' of the injection system and comprises a circular part 41 surrounding the injection pipe 40'*b* with a constant radius.

This circular part 41 has identical dimensions to the injector body 40'*a*. From this circular part 41 extends an opening 42 through which air from the diffuser 60 is introduced. The opening 42 has a straight part 43 tangent to the circular part 41 and a divergent part 44 from the circular part 41 (or convergent from the air inlet). Of course, the manifold may have other shapes. The circular shape of this circular part 41 allows facilitating the rotation of the air flow around the implantation axis of the twists which is congruent with the injector axis AA' in the exemplary embodiment illustrated in FIGS. 6 and 7.

Figure 8:
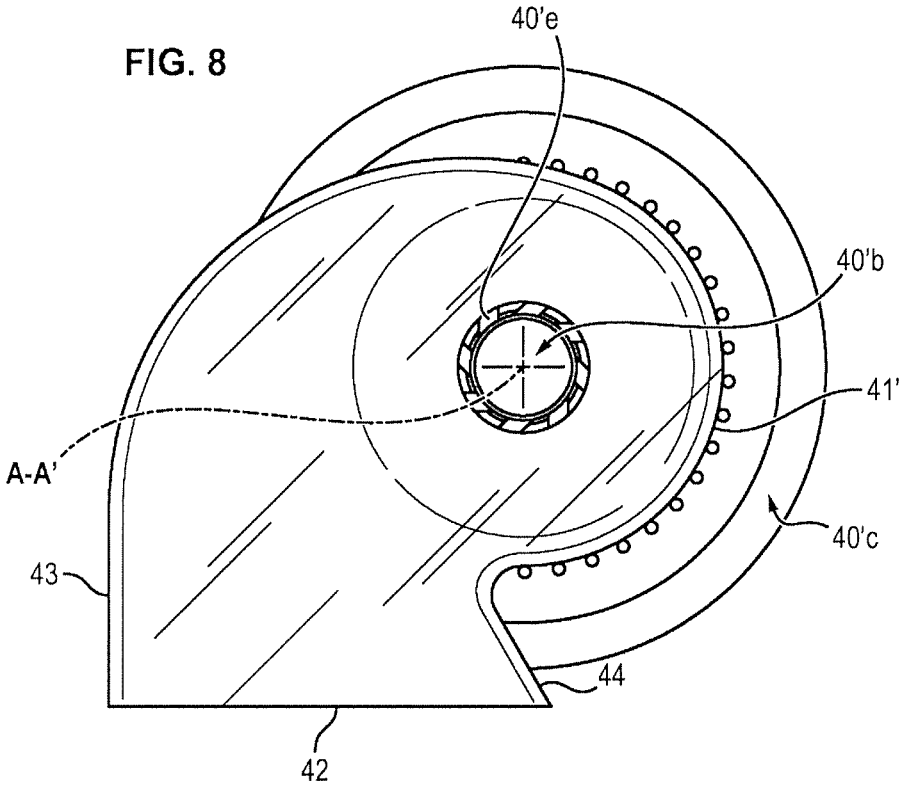
FIGS. 8 and 9 illustrate a manifold of a second type of the combustion chamber according to the second embodiment.
Figure 9:
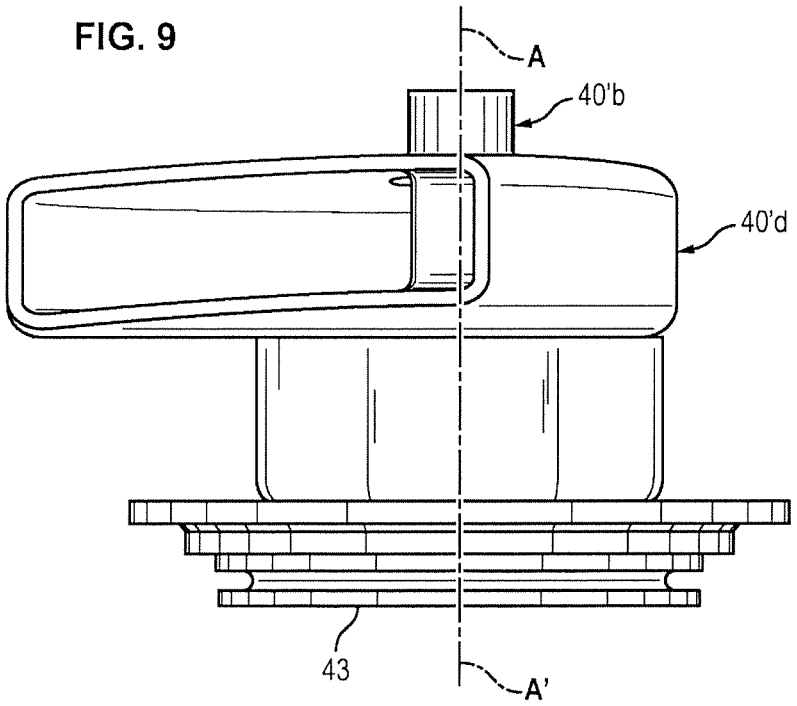

Alternatively, as illustrated in FIGS. 8 and 9, the air manifold 40'*d* may be offset with respect to the axis AA' of the injector. In these figures, it is offset to the left but may of course be offset to the right of the axis AA' of the injector.

For this reason, the manifold comprises a circular part 41' having an increasing radius around the injection pipe (non-constant radius around the injection pipe). Advantageously, the circular part 41' extends first along a constant radius over a first portion, and an increasing radius beyond (volute type shape). And from this circular part 41' extends the opening 42 having a straight part tangent to the circular part and a divergent part 44 from the circular part.

The opening 42 may have several shapes: rectangular, circular or profiled.

Consequently, air from the diffuser enters the injection system through the opening 42, which thanks to its shape allows a general rotary motion to be imposed on the air flow to allow the feeding of the twists 40'*e*.

In addition, depending on the shape and the dimensions given to the opening 42, the latter may avoid that water entering the engine in the case of water or hail ingestion enters the manifold and is then injected into the flame tube, particularly in the primary combustion zone. For this reason, the outer radius of the opening 42 may be judiciously adapted so as not to capture water (liquid or vapor) which is located preferentially on the outside radii of the centrifugal wheel and the axial diffuser.

The invention claimed is:

1. A turbine engine, comprising:

a combustion chamber comprising:

an outer casing;

a flame tube connected to and disposed within the outer casing, the flame tube comprising:

an inner wall having a first end and a second end; and an outer wall having a first end and a second end, wherein the inner and outer walls define:

a radial portion of the flame tube that extends along a radial axis, the radial axis extending transverse to a rotational axis of the turbine engine, the radial portion including an inlet of the flame tube located adjacent the first end of the inner wall and the first end of the outer wall; and an axial portion of the flame tube that extends along a longitudinal axis, the longitudinal axis extending parallel to the rotational axis of the turbine engine, the axial portion including an outlet of the flame tube located adjacent the second end of the inner wall and the second end of the outer wall;

a chamber base extending between the inner and outer walls, the chamber base coupled to the first end of the inner wall and to the first end of the outer wall such that the chamber base is located at the inlet of the flame tube; and a fuel injection system configured to inject fuel in the flame tube via the inlet of the flame tube, the fuel injection system attached to the chamber base and located between the chamber base and the outer casing, the fuel injection system comprising:

a connection structure disposed in an opening in the chamber base;

an injection pipe;

an injector body having a first end and a second end, the second end of the injector body in direct contact with the connection structure, the injector body extending along and arranged around an injector axis, the injector body surrounding the injection pipe, the injector axis extending parallel to the radial axis;

twists arranged around an implantation axis and surrounded by the injector body, the implantation axis being parallel to the injector axis; and an air manifold arranged around the injection pipe and in direct contact with the first end of the injector body, the air manifold located axially between the first end of the injector body and the outer casing, the air manifold comprising a cylindrical part and a channel defining an opening extending from the cylindrical part, the cylindrical part arranged around the injector axis, the channel extending along a longitudinal channel axis that is parallel to the rotational axis of the turbine engine and perpendicular to the injector axis, the channel configured to direct air flow along the longitudinal channel axis and into the cylindrical part, the air manifold located between the first end of the injector body and the outer casing such that air initially flows into the channel defining the opening to the cylindrical part and around the implantation axis within the cylindrical part and subsequently flows from the cylindrical part into the injector body and to the twists.

2. The turbine engine according to claim 1, wherein the channel defining the opening comprises a straight part which extends tangentially to the cylindrical part and a divergent part extending from the cylindrical part.

3. The turbine engine according to claim 1, wherein the cylindrical part has a constant radius around the injector axis.

4. The turbine engine according to claim 1, wherein the cylindrical part has an increasing radius around the injector axis.

5. The turbine engine according to claim 1, wherein the channel defining the opening has a cross-sectional shape which is one of circular and rectangular.

6. The turbine engine according to claim 1, wherein the flame tube is connected to the outer casing via the fuel injection system.

7. The turbine engine according to claim 1, wherein the injector axis is coaxial with the radial axis of the radial portion.

8. The turbine engine according to claim 1, wherein the flame tube further comprises a bend portion extending between and connecting the radial portion and the axial portion.

* * * * *